US007059017B1

(12) United States Patent
Rosko et al.

(10) Patent No.: US 7,059,017 B1
(45) Date of Patent: Jun. 13, 2006

(54) SLIDING DOOR ASSEMBLY FOR TRACK, STEP PLATE, ROLLER, GUIDE AND CONSTRAINT SYSTEMS

(76) Inventors: Peter J. Rosko, 975 Eastham Way #204, Naples, FL (US) 34104; Larry Scott, 11520 Chaplis La., Estero, FL (US) 33928

( * ) Notice: Subject to any disclaimer, the term of this patent is extended or adjusted under 35 U.S.C. 154(b) by 0 days.

(21) Appl. No.: 11/028,246

(22) Filed: Jan. 4, 2005

(51) Int. Cl.
*B61D 19/00* (2006.01)

(52) U.S. Cl. ..... 16/96 R

(58) Field of Classification Search ..... 16/96 R, 16/94 R; 321/334.24, 334.25, 334.27; 49/116, 49/425, 404, 410, 411, 453, 471
See application file for complete search history.

(56) References Cited

U.S. PATENT DOCUMENTS

| | | | | |
|---|---|---|---|---|
| 2,374,490 | A * | 4/1945 | Lehman | 4/557 |
| 2,944,282 | A * | 7/1960 | Greco | 16/87 R |
| 2,950,756 | A * | 8/1960 | Moloney | 160/91 |
| 3,584,417 | A * | 6/1971 | Gatton et al. | 49/404 |
| 3,855,732 | A * | 12/1974 | Sheaf | 49/425 |
| 4,098,027 | A * | 7/1978 | Crance | 49/504 |
| 4,125,141 | A * | 11/1978 | Stillwell | 160/91 |
| 4,208,755 | A * | 6/1980 | Shepherd | 15/160 |
| 5,341,600 | A * | 8/1994 | Heppner | 49/471 |
| 5,488,803 | A * | 2/1996 | George | 49/425 |
| 6,041,551 | A | 3/2000 | Aspenwall | |
| 6,131,340 | A * | 10/2000 | Clark et al. | 49/410 |
| 6,199,331 | B1 * | 3/2001 | Hunt | 52/207 |

FOREIGN PATENT DOCUMENTS

| | | | |
|---|---|---|---|
| CA | 4344206 | | 8/1982 |
| DE | 3238204 | A1 * | 4/1984 |
| EP | 241063 | A1 * | 10/1987 |

* cited by examiner

*Primary Examiner*—J J Swann
*Assistant Examiner*—Mark T. Vogelbacker

(57) ABSTRACT

The invention corrects three major safety and security problems, associated with millions of traditional sliding doors. It offers a dramatic, yet simplistic, solution to these chronic problems in addition to providing a smooth, maintenance-free operation. The invention eliminates the protruding longitudinal rails of the traditional floor track that create a barrier to foot and wheel traffic. In its place is a smooth, level track that conforms to the "Americans with Disabilities Act of 1990". Secondly, the invention is secure against unauthorized (forced) entry. Thirdly, the invention is not displaced by hurricane-force winds. For maximum strength and function, solid nylon rollers are positioned at each end between metal guides running the length of the panel base. Adjustable constraints are positioned at each end on top of each panel. The combination of the pair of guides seated into their respective track channels, and the constraints, prevent unauthorized entry and displacement.

3 Claims, 14 Drawing Sheets

SLIDING DOOR ASSEMBLY FOR TRACK, STEP PLATE, ROLLER, GUIDE AND CONSTRAINT SYSTEMS

BACKGROUND OF THE INVENTION

Traditional sliding glass doors are present in the majority of homes, and many American businesses, across the United States. Unfortunately, many of these sliding doors are cosmetically designed and are seriously deficient in functional value.

Until now, very little significant improvement has been made by incorporating esthetics, function, safety and security into a single sliding door. It is our strong belief that the invention, being submitted with this application, satisfies all of these requirements.

Traditional Sliding Doors

ESTHETICS: A traditional sliding door track is primarily designed with a longitudinal metal rail, protruding vertically from its base, to guide each door panel. Common complaints include the actual design of the track (its obtrusive "ridges"), the track's affinity for collecting dirt, the deposition of a black metallic residue on the track's surface (caused by the door's metal wheel dragging against its guide rail) and the difficulty in keeping the track clean.

FUNCTION: Traditional sliding door panels are normally equipped with inverted "V"-shaped metal wheels that are attached to each end of its base. The two wheels occlude with a single longitudinal metal rail that comprises the length of the track, enabling the door to slide sideways. The entire door's weight is centered on the apex of the inverted "V"-shaped wheels. This type of design creates drag instead of a free-flowing glide. Over time, this stress results in premature wear including breakage of the wheels and door handles.

SAFETY: The traditional sliding door track, predominantly designed with metal rails, is a serious impediment to both foot and wheel traffic. Even in the presumed safety of one's home, the persistence of this faulty design has caused a multitude of accidents over the years. Tripping and falling have been common complaints. This is a more serious problem with the ambulatory, physically impaired such as those afflicted with Parkinson's disease. Their shuffling feet find great difficulty in negotiating anything that is not level. In addition, the handicapped in wheelchairs find it mostly impossible to traverse this impediment without able assistance.

SECURITY: The design of the vast majority of sliding glass doors on the market is seriously deficient in offering the consumer protection from forced entry and violent weather (i.e. hurricanes and tornadoes). Forced entry has been a serious problem, for homeowners and their insurance companies, ever since the railed track was introduced. It has been responsible for escalating insurance claims due to accidents and damages from forced entry and violent weather. Because of its thinness, and lack of vertical prominence, only minimal effort is required to jack the door panel off its rail resulting in easy displacement and removal. Thieves love these traditional sliding glass doors! Hurricanes and tornadoes can cause flexing of the poorly designed rail. Even with a constraining device (i.e. metal shim), mounted on top of the sliding door panel, it cannot prevent displacement as a result of wind-induced forces causing lateral and upward movement of the panel.

BRIEF SUMMARY OF THE INVENTION

The invention was born out of years of frustration with operating and maintaining sliding doors in residential and commercial buildings.

This is an uncomplicated, yet highly efficient and versatile, invention applicable to commercial and residential sliding door and window systems. It is a unique and innovative departure from traditional sliding door assemblies by improving upon esthetics, function, safety and security. A special safety feature addresses the "Americans with Disabilities Act of 1990". By its inherent design, any barrier or hazard to foot (i.e. walker) or wheel (i.e. wheelchair) traffic is completely eliminated. From a security standpoint, this invention will completely eliminate the displacement of the sliding door from forced vertical entry or hurricane-force winds.

DESCRIPTION OF THE DRAWINGS

A total of (20) drawings are shown.

FIG. 1 shows an enlarged cross sectional end view which includes the metal (aluminum) support housing (19) for the bottom of the door panel [bottom door panel housing] (20), the solid nylon roller (6) and the outside (1) and inside (2) solid metal guides (1&2). The nylon roller (6) is connected to the housing (19) by a stainless steel shoulder bolt (21) that provides free movement within very close tolerances. The shoulder bolt (21) has an inside wall entry (22) with its threaded end (23) fastened to a threaded slot (24) on the outside wall (25). The bolt head (26) is designed to accommodate an Allen wrench or Phillips screwdriver.

FIG. 2 is the sliding door track (5), which includes the outside (3) and inside (4) guide channels (3&4) and stainless steel (s.s.) anchor screws (75) in the concrete slab (26). Options include channel drains (27); a 10–30 degree angled fixed step plate (28) with s.s. anchor screw[s] (75) and an optional longitudinal frame (29) on the inside wall, mounted with s.s. retention screws (30), to support an insulator pad (31) for use in cold climates.

FIG. 3 is a top sectional view of a single sliding track (5) with its outside (3) and inside (4) guide channels (3&4), optional channel drains (27), weep hole (32), optional fixed angled step plate (28) and anchor screw holes (76).

FIG. 4 is similar to FIG. 3 except this is a 3-track design (33) instead of a single track.

FIG. 5 is a vertical, underside sectional view of the bottom door panel housing (20). This includes the outside (1) and inside (2) guides, a pair of solid nylon rollers (6), outside (34) and inside (35) walls, heads of the shoulder bolts (26) and space for the door panel seat (36).

FIG. 6 is an angled sectional view of the inside portion of the bottom door panel housing (20). This includes the outside (1) and inside (2) guides, the removed solid nylon roller (6), the s.s.shoulder bolt (21) with its threaded end (23), the shoulder bolt slot (24) and the fully seated head of the shoulder bolt (26).

FIG. 7 is an outside view of the "sliding door floor assembly". The top section is comprised of the all-metal housing (19) which includes the outside (1) and inside (2) guides and the seat (37) for the bottom of the door panel (77). The lower section is comprised of the all-metal track (5) which includes the outside (3) and inside (4) guide channels (3&4), the optional angled step plate (28), the glide surface (38) for the nylon roller (6) and the anchor screw hole(s) (76).

FIG. 8 is a cross sectional view of FIG. 7. It demonstrates the extent to which the guides (1&2) seat into their corresponding guide channels (3&4). Unlike traditional tracks, there is no metal-to-metal contact between the two occluding surfaces. The drawing also includes the solid nylon roller (6), optional angled step plate (28) and the bottom door panel housing (20).

FIG. 9 is an angled view of the underside section on the bottom of the door panel housing (20). The primary purpose is to show one solid nylon roller (6) fastened in place with the other (6) out of its compartment (39). This exposes its shoulder bolt (21) and threaded end (23) plus its entry (40) and fastening (24) slots (40&24). Also included are the outside (1), and inside (2), guides (1&2).

FIG. 10 is a sectional drawing showing how the guides (1&2) and rollers (6), on the bottom of the sliding door panel housing (20), line up to the guide channels (3&4) on the sliding door track (5). This view shows the "sliding door floor assembly" with the track (5), and its opposing housing (20), separated from each other. In comparison, FIG. 7 shows the same "sliding door floor assembly" fully occluded (78). Prominent features include the solid nylon rollers (6) and the outside (1) and inside (2) guides (1&2) in alignment with their respective outside (3) and inside (4) guide channels (3&4). Also shown are the optional angled step plate (28) and anchor screw holes (76) in the track (5).

FIG. 11 is an outside sectional view of an optional, self-adjusting hinged step plate (41) welded (42) to the outside guide channel (3) portion of the track (5). The step plate (41), and track (5), are attached by a connecting rod (43) seated in the hinge slots (44) and fastened with conventional cotter pins (45). This type of step plate (42) would be used in larger commercial, or industrial, applications.

FIG. 12 is an angled cross sectional view of the track (5) specifically showing the outside guide channel (3). Also included are the inside guide channel (4), the optional fixed angled step plate (28) and anchor screw holes (76).

FIG. 13 is a cross sectional view of an optional removable metal guide channel housing (53) within the track (5). The housing includes the removable frame (54), the frame seat (55) with attachment screws (56), a felt or nylon bristle lining (57), a vertical channel space (58) to accommodate the outside guide (1) and retention slots (59) on each end for easy removal of the channel housing (53) with pronged tongs. The primary purpose of this option is to satisfy those who prefer a meticulously clean track.

FIGS. 14 through 20 include a variety of drawings of the ceiling "constraint assembly".

FIG. 15 is a view looking down into the constraint housing (10) and its constraint lock bar assembly. It includes: the fully threaded lock bolt (12) fastened to the threaded constraint bar (11); the lock bolt head (67), designed to accommodate an Allen wrench or Phillips screwdriver; the threaded lock slot (13); the constraint bar guide channel (14) which permits the constraint lock bar (11) to be vertically moved within close tolerances.

FIG. 16 is a close-up view of FIG. 14 showing the constraint housing (10) and the constraint lock bar slot (15) on top of the door panel (69).

FIG. 17 is an angled view of the constraint housing (10) at the top corner of the sliding door (7). It shows the exterior portion of the constraint lock panel (16) and the constraint lock bar (11) as it elevates through its slot (15) on top of the door (7). The lock panel (16) includes the slide panel (63), lock bolt heads (67), alignment marks (17) for centering the threaded end of the bolt into the lock slot via the bolt head (67), drain hole (18) and the base of the constraint housing (60).

FIG. 18 is a cross sectional side view of the constraint lock assembly (61) inside the constraint housing (10). From outside to inside, this drawing includes the following: Slide panel (63); constraint lock bolt head[s] (67); fully threaded constraint lock bolt[s] (12); adjustable vertical constraint lock bar (11); threaded bolt slot (62) attaches lock bolt to the threaded constraint lock bar to prevent wobbling or torquing of the bar in the event of forced entry or hurricane-force winds. For maximum strength, this drawing shows the use of twin lock bolts (12). To adjust the lock assembly, both lock bolts (12) must be fully extruded from their lock slots (13). Then, it's just a simple matter of sliding either lock bolt head (67) up or down depending upon the desired position of the constraint lock bar (11). To lock the bar (11) in place, center the bolt head[s] (67) between the alignment marks on the lock panel and tighten until flush with the panel as seen on FIG. 17.

FIG. 19 is a cross sectional view of the outside guide channel (3) as it relates to the constraint lock bar (11) and vertical space (64) between the top of the door panel (69) and the inside top of its ceiling track (66) in FIG. 20. FIG. 19 also includes the bottom door panel housing (20) with its outside and inside guides (1&2) and nylon roller (6). This upper section occludes with the track (5) below which includes the outside (3) and inside (4) guide channels (3&4) and optional step plate (28).

Additional information regarding "outside" and "inside guides":

The dimensions of the guides vary in direct proportion to the size of the door being supported. Also, the natural elements to which these doors are subjected is another important consideration. An example is wind-related weather that affects many Gulf and Atlantic states during hurricane season. Another possible variable involves building code requirements. The outside guide (1), and outside guide channel (3), are longer and deeper than their respective inside counterparts to insure additional protection against forced entry. The thickness of both sides remains the same. The guide channels (3&4) are always longer than their respective guides (1&2) to avoid metal-to-metal contact. All of these dimensions increase as the load increases. As a result, the general measurement for the guides and guide channels vary as follows:

Guide length: Outside guide (¾"–5¾"L) . . . Inside guide (½"–4¾"L)

Guide width: Same for both (3/16"–⅞"W)

Guide channel length: Outside channel (⅞"–6"L) . . . Inside channel (5/16"–5"L)

Guide channel width: Same for both (¼'–1"W)

Sliding Door Loads and Their Relation to Rollers

Heavier loads may require the use of additional nylon rollers or upgraded to axled metal rollers mounted on ball bearing races.

Figure 14:
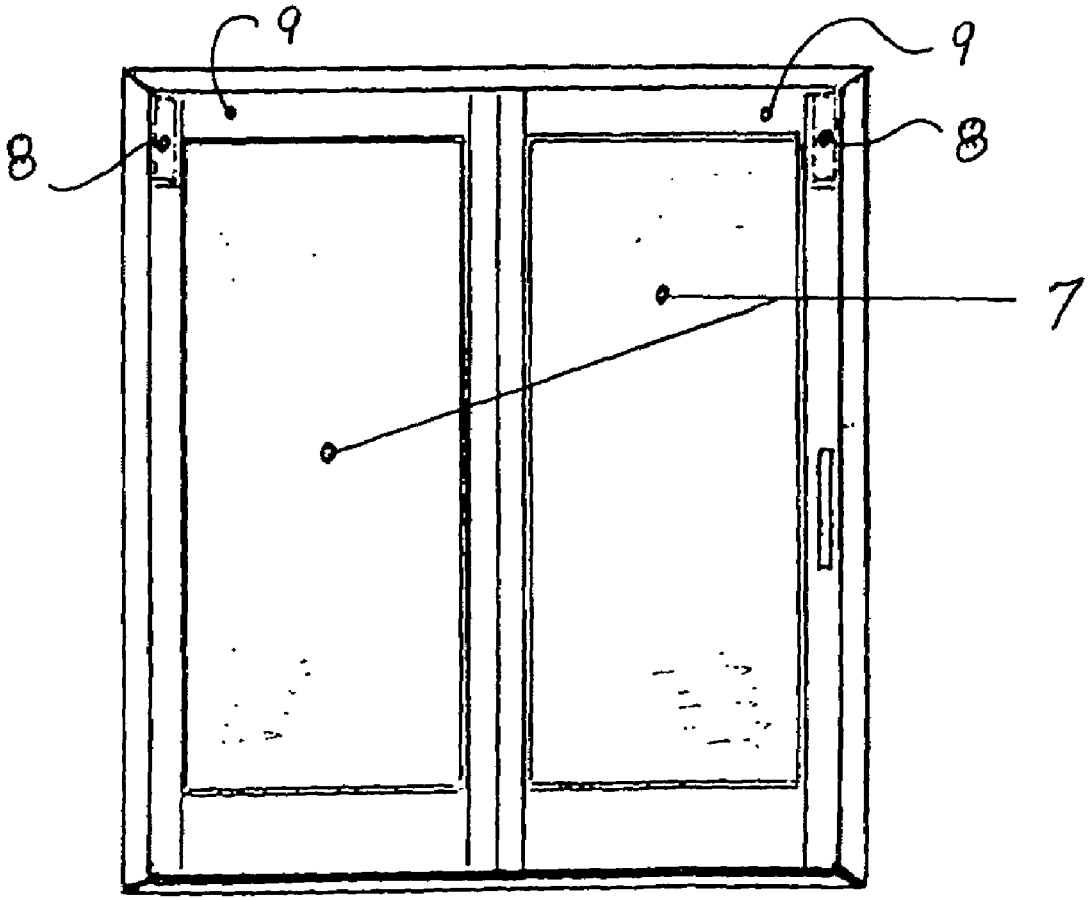
FIG. 14 is a full, miniature view of a framed two-panel sliding door (7) showing the location of the constraint housings (8) at each ceiling end of the door panel (9).
Figure 17:
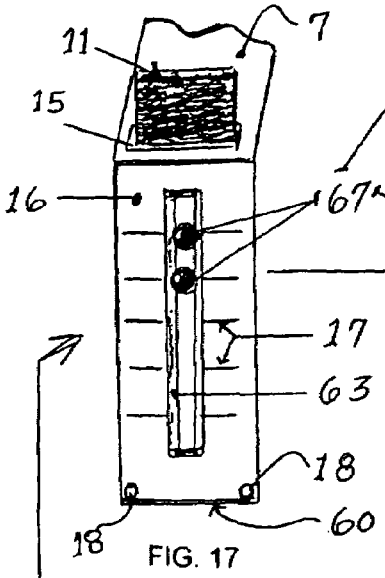
Figure 18:
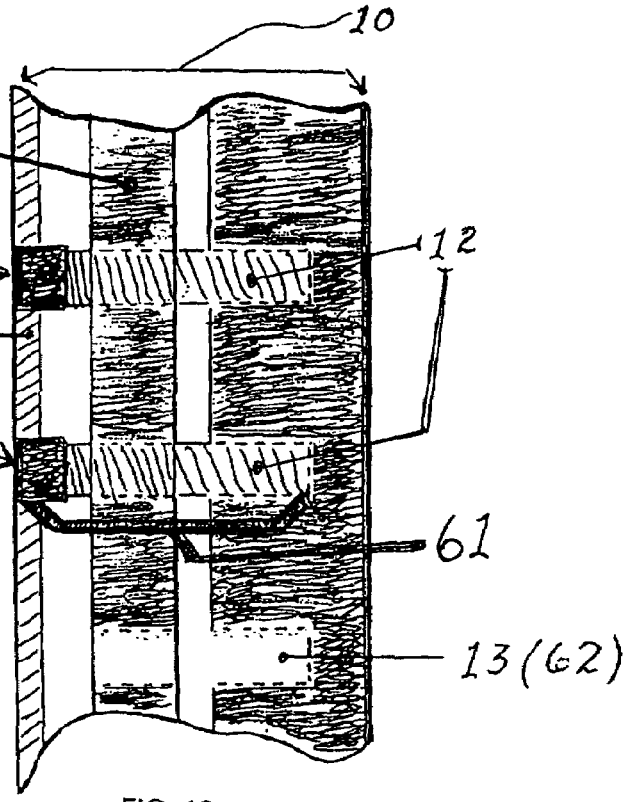
Figure 16:
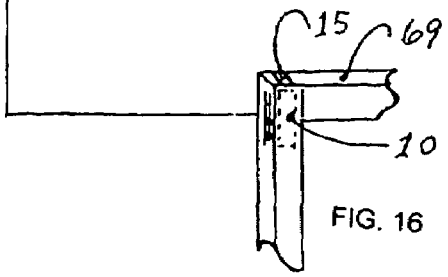
Figures 19, 20:
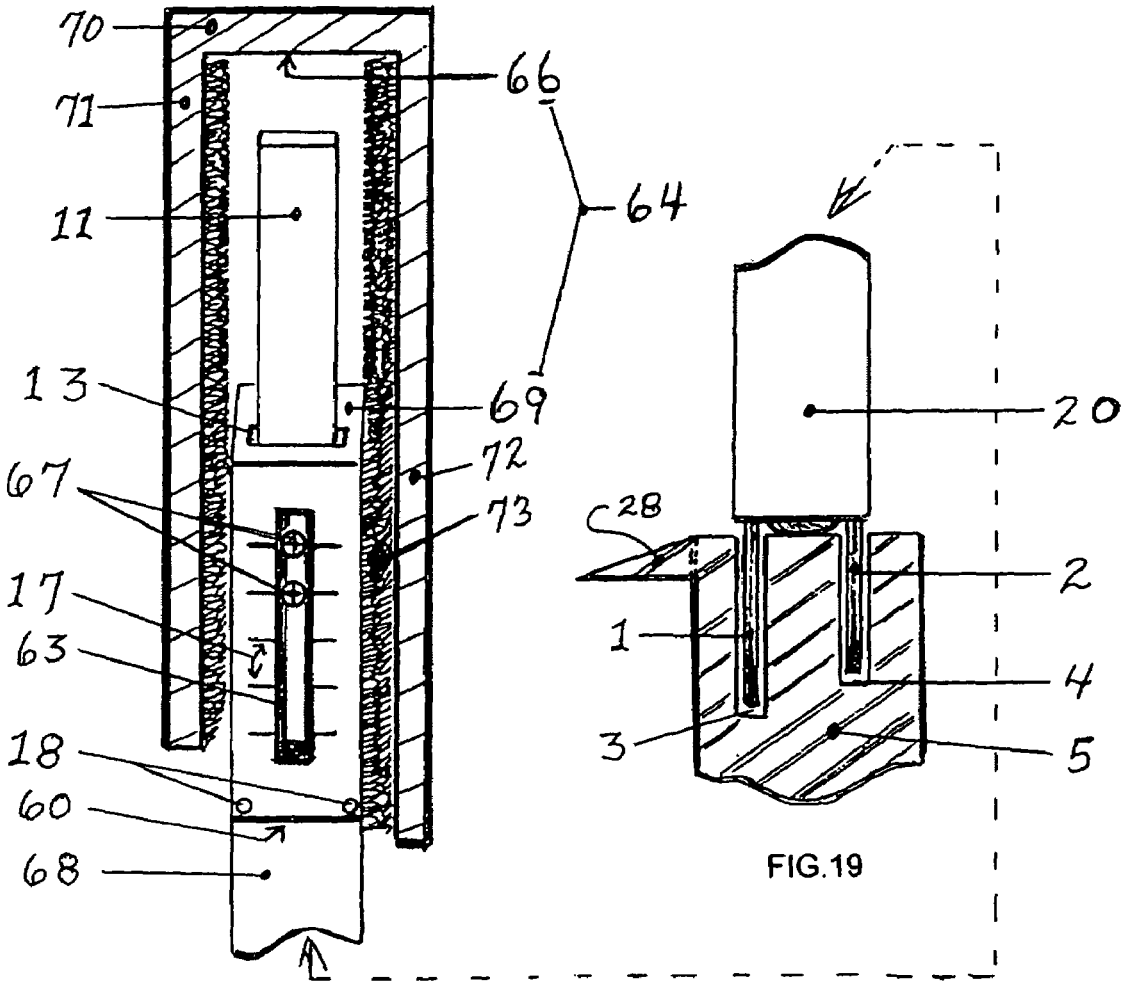

FIG. 20 is a cross sectional, expanded view of the vertical constraint lock bar (11), and its adjustment panel, inside its ceiling track frame (70). The door panel section includes: The side of the door not exposed to outside tampering (68); the base of the constraint lock assembly (60) with drain holes (18); alignment marks (17) for the lock slots; lock bolt heads (67); slide panel (63); top of door panel (69) with the constraint lock bar slot (15); constraint lock bar (11) elevated in locked security position. The ceiling track section includes: The metal frame (70) [the outside frame (71) is slightly shorter than the inside frame (72) to facilitate easier removal by tilting outward]; felt lining (73) [aids as a non-abrasive containment surface as the door panel slides within the track]; vertical ceiling space [VCS] (64) is the space between the top of the door panel (69) and the inside top of the ceiling track (66). In order for the sliding door panel (#7, FIG. 14) to be intentionally lifted and removed off its track (5), the constraint lock bar (11) must be fully retracted within the constraint housing (10) and the VCS (64) must exceed the length of the longest (outside) guide (1) by a minimum of 20%. For example, if the outside guide measures 3 inches, then the VCS must be at least 3.6 inches. In order to be fully constrained, both guides (1&2) on the bottom door housing (20) must be seated in their respective track channels (3&4) with the constraint lock bar (11) elevated, and locked, to just out of contact with the inside top of the ceiling track (66). Once the sliding door assembly is installed, and the constraints are positioned, no further adjustments should ever be necessary. Because of the quality and simplicity of the invention, repairs or replacement also should never be necessary.

DETAILED DESCRIPTION OF THE INVENTION

Utilizing time-proven marine architecture technology, the invention is designed with special attention to strength and stability. One of its innovative features is the elimination of the rails on the traditional sliding track. The single-track rail is replaced with a pair of solid metal rails referred to as the outside and inside guides. This is similar to a "tipsy" single hull boat being replaced with the more stable twin hulls of a catamaran. To further increase its stability against displacement, the outside guide is made longer than the inside guide. The same principle is incorporated in sailboats.. the longer the keel, the greater the stability.

Figure 11:
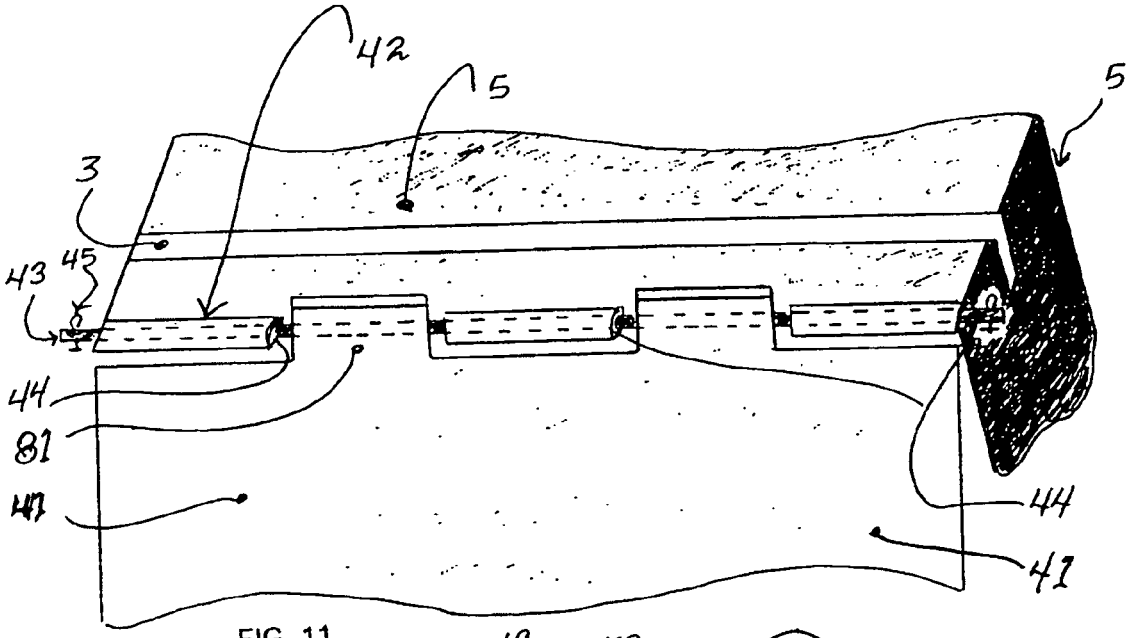
Figure 11B:
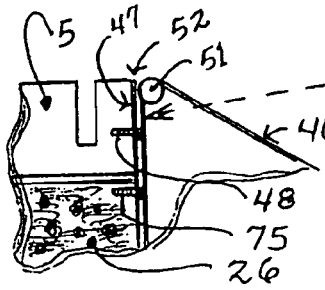
FIG. 11B is a cross sectional view of FIG. 11A's step plate (46) connection to the outside track/foundation surfaces (47&26). A stainless steel metal screw (48), and anchor screw (75), attach the metal flange (79) to the track (5) and its foundation (26). Of all three types of step plates [a) Solid part of the track (28). b) Welded and hinged (42). c) "After market" hinged with screw attachment (41)], the "after market" (41) is the most versatile. Not only is it self-adjusting, it can also be added to any type of track where a step must be eliminated to allow for unimpeded foot or wheel traffic. Also shown in FIG. 11B are the sliding door track (5) with its guide (3) and the concrete foundation (26) under the track (5).
Figure 11A:
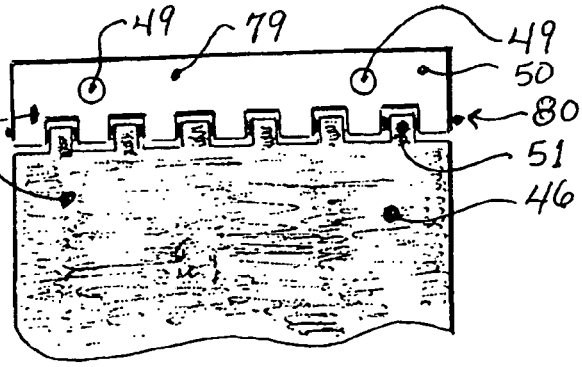
FIG. 11A is a smaller sectional view of an optional "after market" (46) self-adjusting hinged step plate (41) that can be attached to the track (5) in the invention, or to other types of existing tracks, that are not level with the floor. Connect the "after market" hinged step plate (41) to the outside wall of the track (47), or its foundation (26), by simply drilling stainless steel metal (48), or anchor (75), screws (48&75) through the pre-drilled holes (49) in the metal attachment flange (79). The side of the flange (79) that you see is turned vertically 180 degrees so that it is the side (50) that contacts the outside surface of the track (47) or its foundation (26). This forms an inverted "V" angle with the hinge (51) being level with the outside corner of the track (52). To gain access to the screw holes (76), lift the step plate (41) vertically without moving the attachment flange (79) from its pre-set drill position. Note: The two end hinge slots (44) can be closed by welding the end of the connecting rod tips (80) to the hinge slots (44), or crimping, for permanent fastening of the two separate hinged sections (52).
Figure 12:
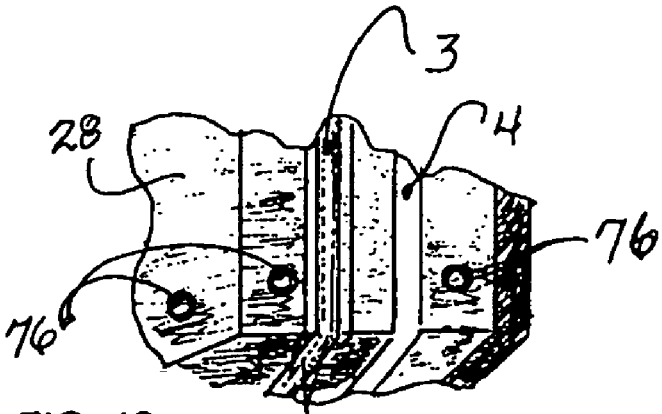
Figure 13:
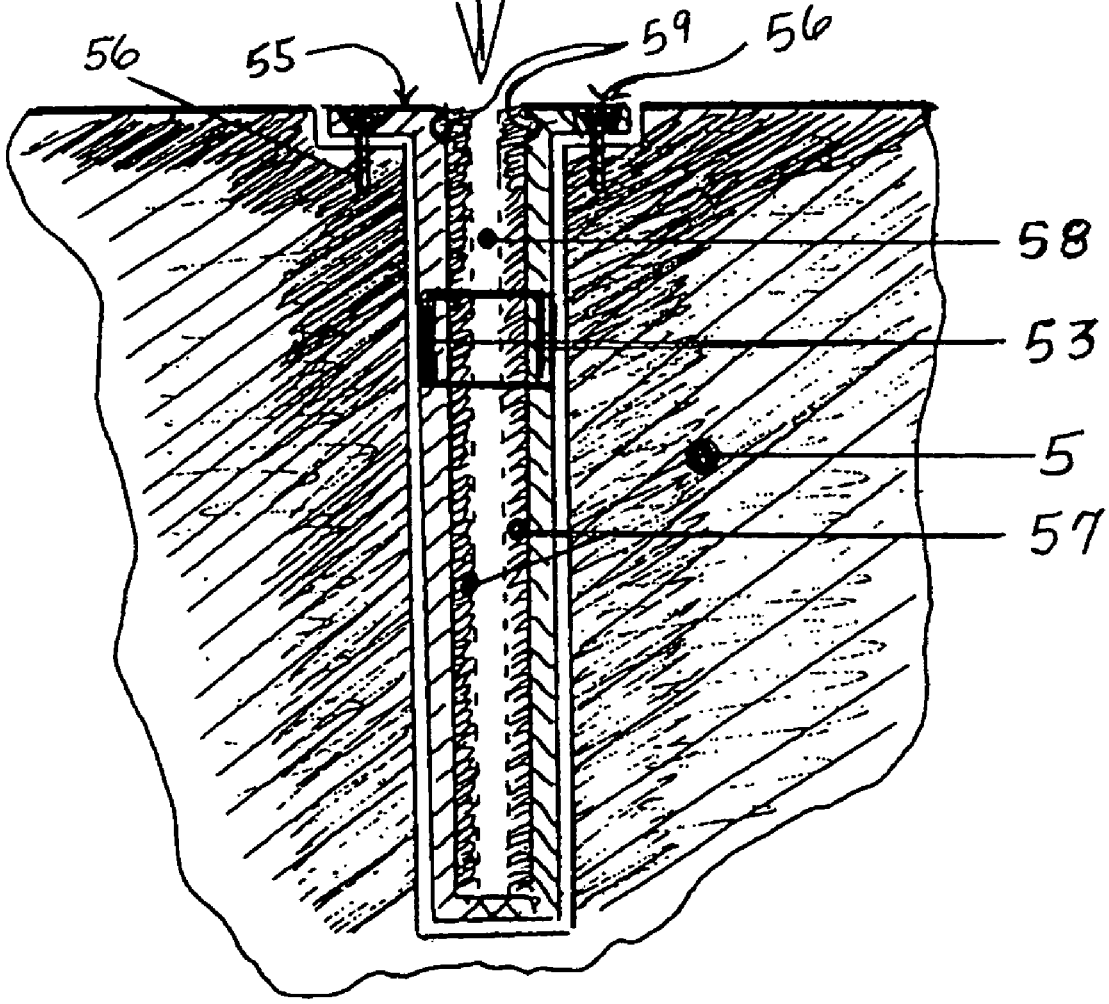
Figure 15:
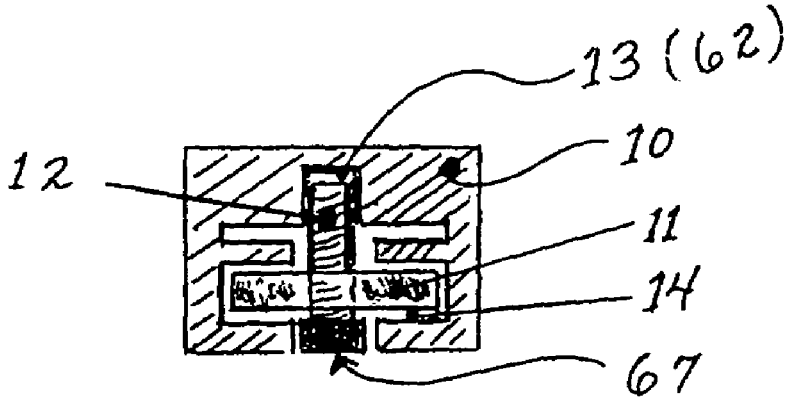

The core of the invention consists of two occluding sections. The lower, or track, section which consists of the outside and inside guide channels running along the entire length of a smooth and level track. The inside section of the track is cornered at a 90-degree angle to match the level of the floor in the inside room. The various drawings show an outside track section which consists of an optional angled step plate to accommodate a smooth transition, by foot or wheel, to the outside in case of a drop in the floor. Two other optional step plates are designed with hinges and would be self-adjusting. These would not be a direct (fixed) part of the track as shown in FIGS. 2,3,4,7,8 & 10. Instead, they would be attached with welds or screws as shown in FIGS. 11, 11A & 11B. Otherwise, the outside section will also be cornered at 90 degrees with the track surface being level with the floor.

The upper section consists of a solid nylon roller on each end on the bottom of the door panel in between outside and inside guides, which extend the entire length of the door. The guides (male portions) on the door panel occlude with the guide channels (female portions) on the track within very close tolerances. The rollers and guides are designed for the sliding door to function with a smooth, gliding motion without wobbling.

ESTHETICS: Since the working surface of the track is flat and there is no metal-to-metal contact of wheel to rail, the track will be free of the traditional dirt and black residue. It also replaces the eyesore of conventional protruding rails.

FUNCTION: The sliding door's two traditional inverted "V"-shaped metal wheels are replaced with two solid and whole nylon rollers that contact the glide path of the track in their entirety. This results in a free flowing, gliding action as the door slides. It is comparable to an axled wheel mounted on ball bearing races and is practically impervious to wear or replacement. By replacing the rails on the track with a pair of guides then relocating them to each side of the rollers on the base of the door panel, all of the deficiencies of the traditional sliding track are corrected by making it smooth and level. The insertion of the two guides into the track's two channels completes the "sliding door guiding system".

The outside guide, and outside guide channel, are deeper than their respective inside counterparts. The thickness of both sides remains the same. The depths and thickness, of the guides and channels, vary in proportion to the surface area being supported. For example, a residential sliding door would require less depth and thickness than that of a three-story sliding door for a boat storage condo. Neither guide contacts the base of its respective channel.

Unlike traditional railed track designs, there is no continuous metal contact with this invention. The contacts between each door panel and its opposing track are the two solid nylon rollers, with one on each end. Note: Axled metal rollers, mounted on ball bearing races, will replace nylon rollers for larger commercial and industrial sliding doors.

Functional Options

Figures 1, 2:
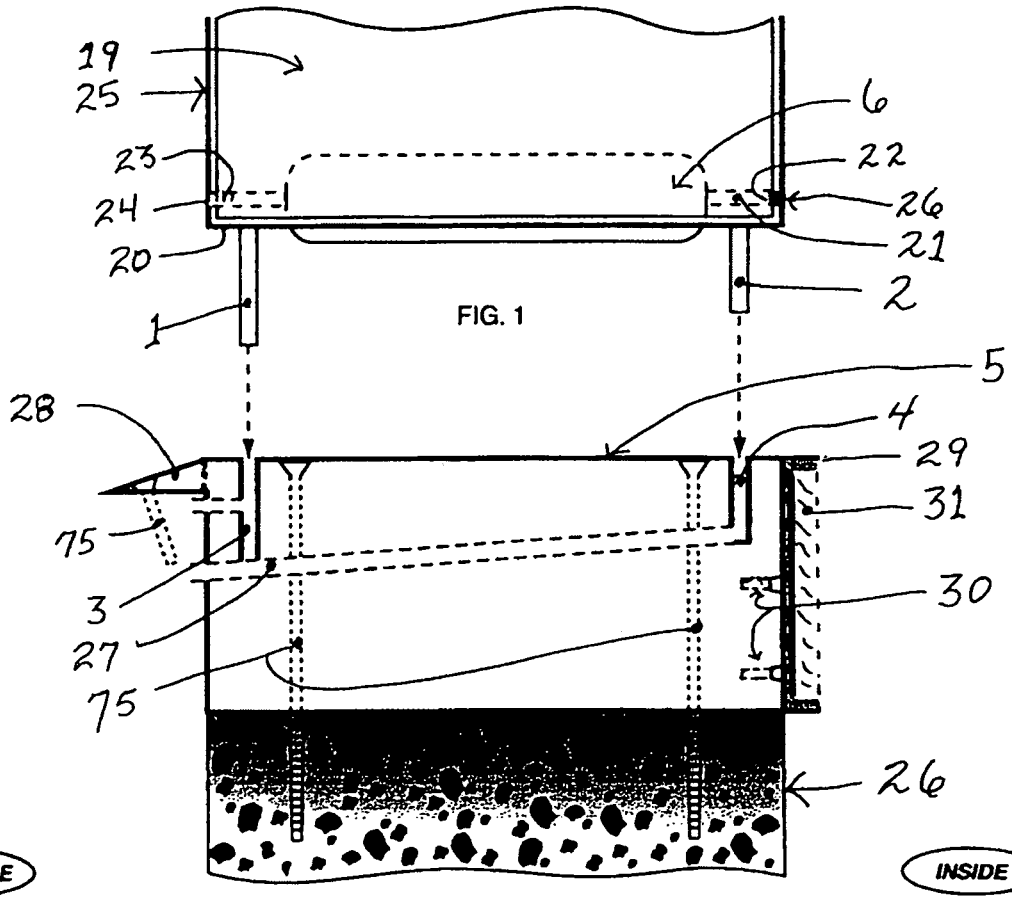
FIGS. 1 through 13 include a variety of drawings of the sliding door "floor assembly". It includes the glide system (rollers); the guide system (guides, guide channels, track and angled step plate. The step plate can be fixed, hinged & fastened by welding or hinged & fastened by screw).
Figure 3:
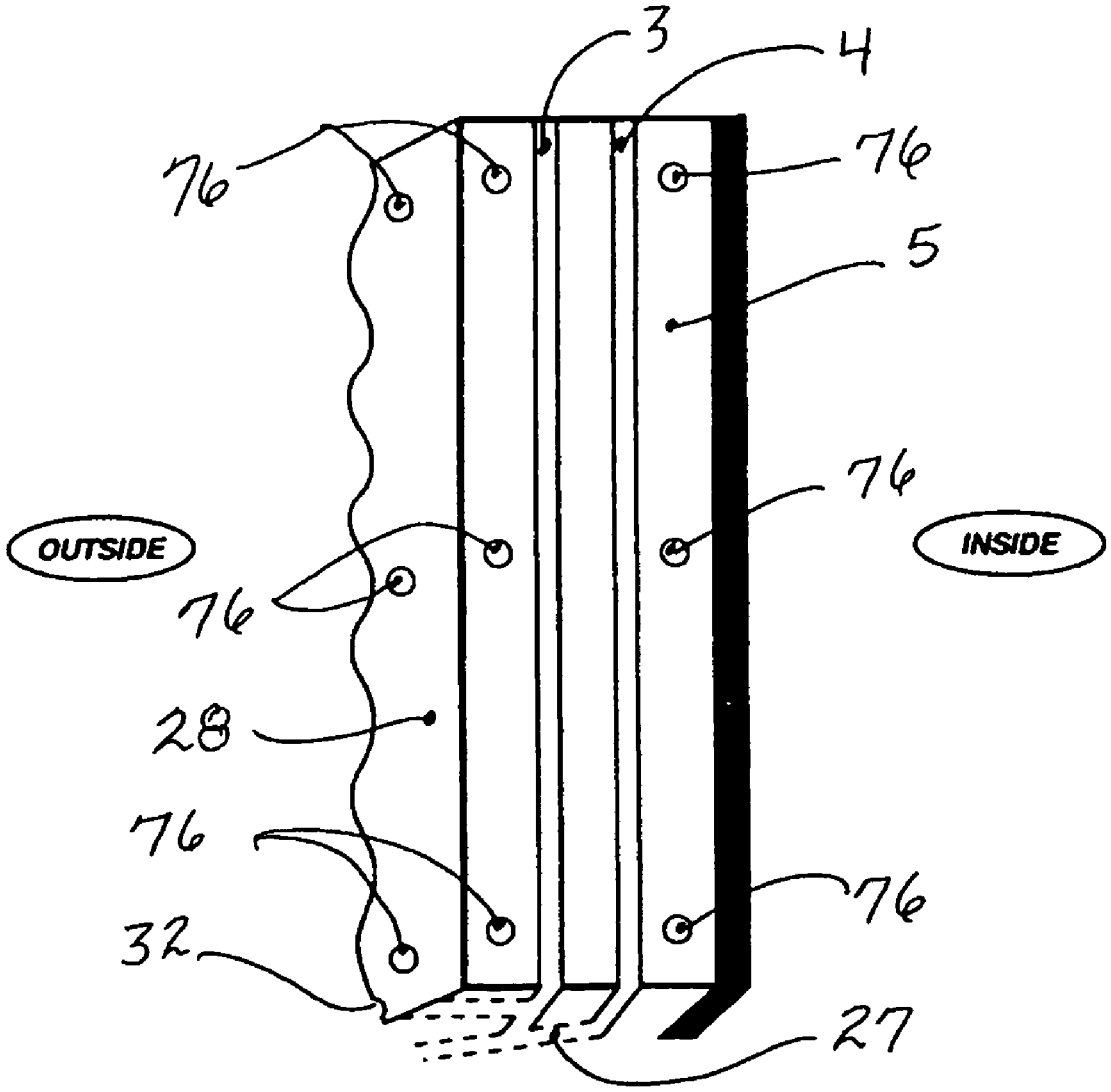
Figure 4:
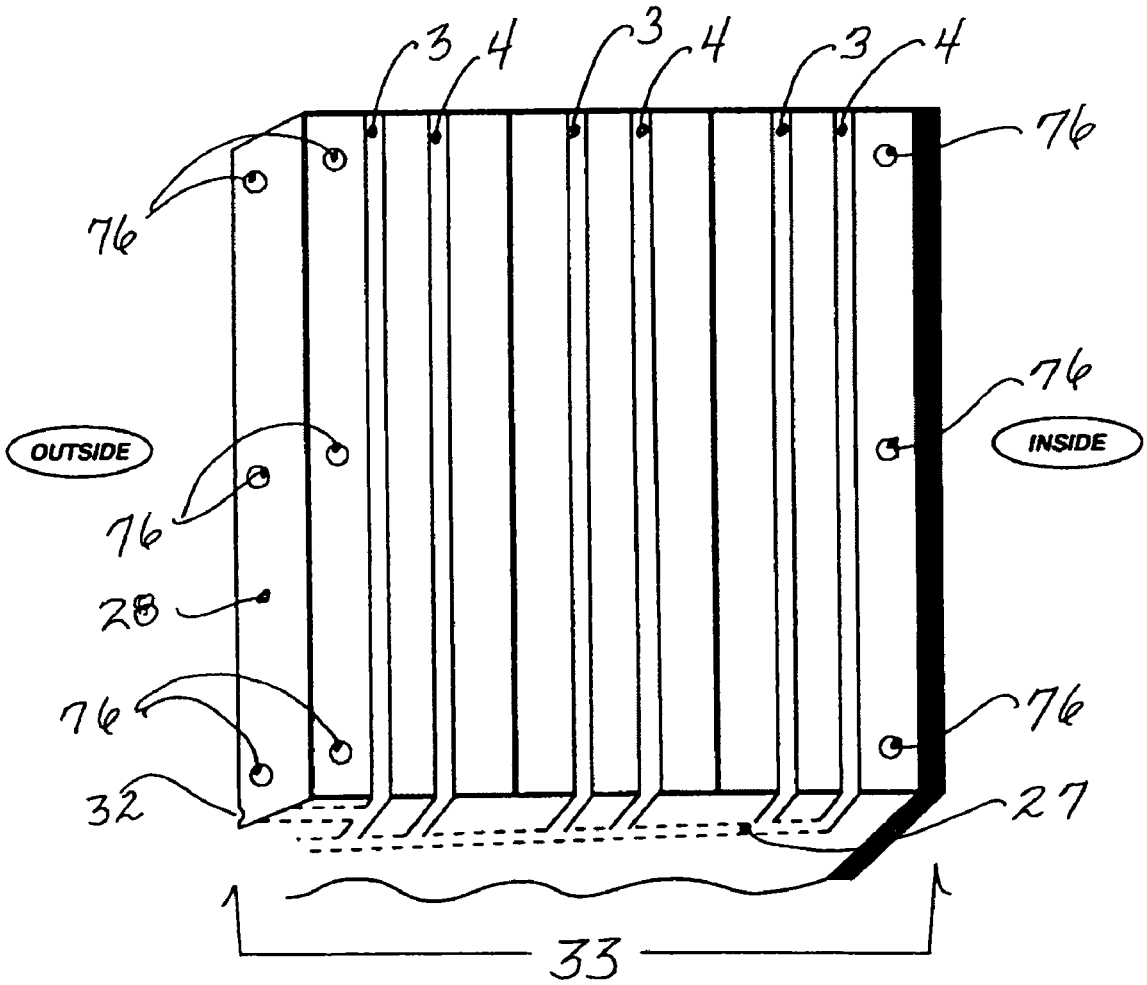
Figure 5:
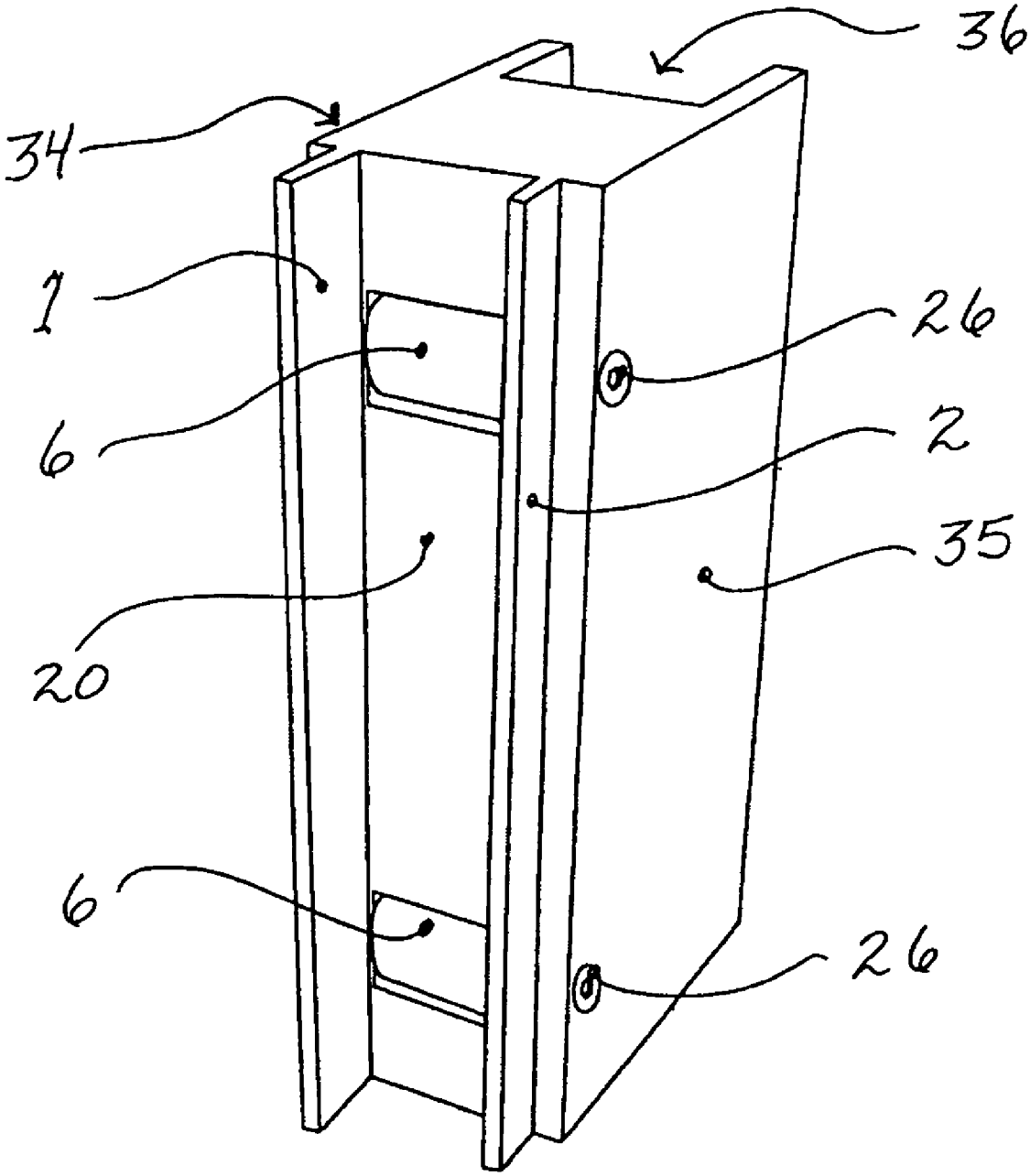
Figure 6:
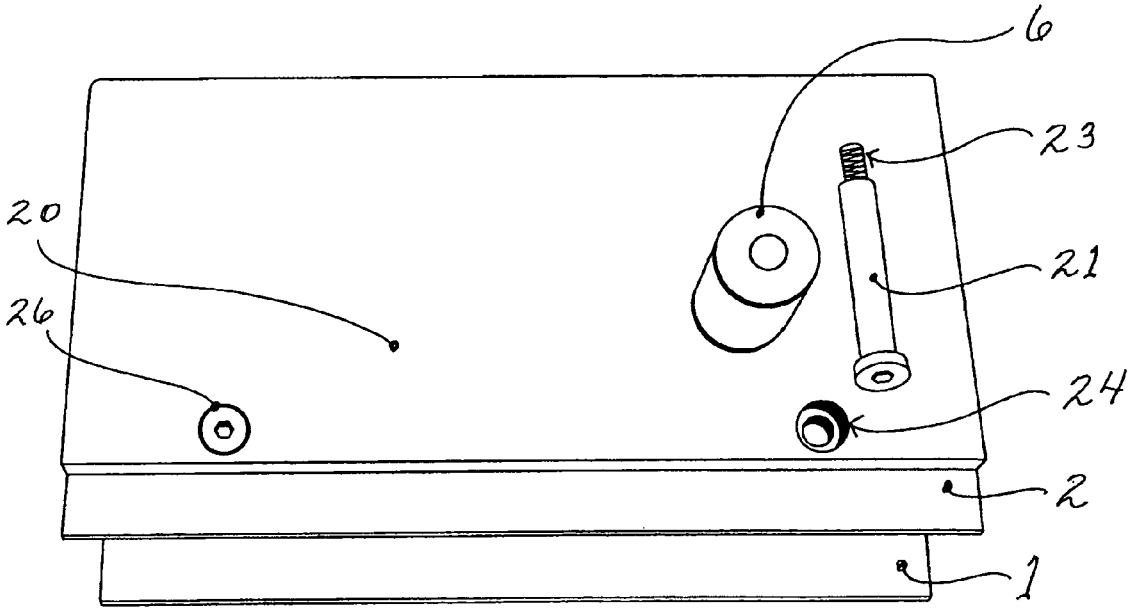
Figure 7:
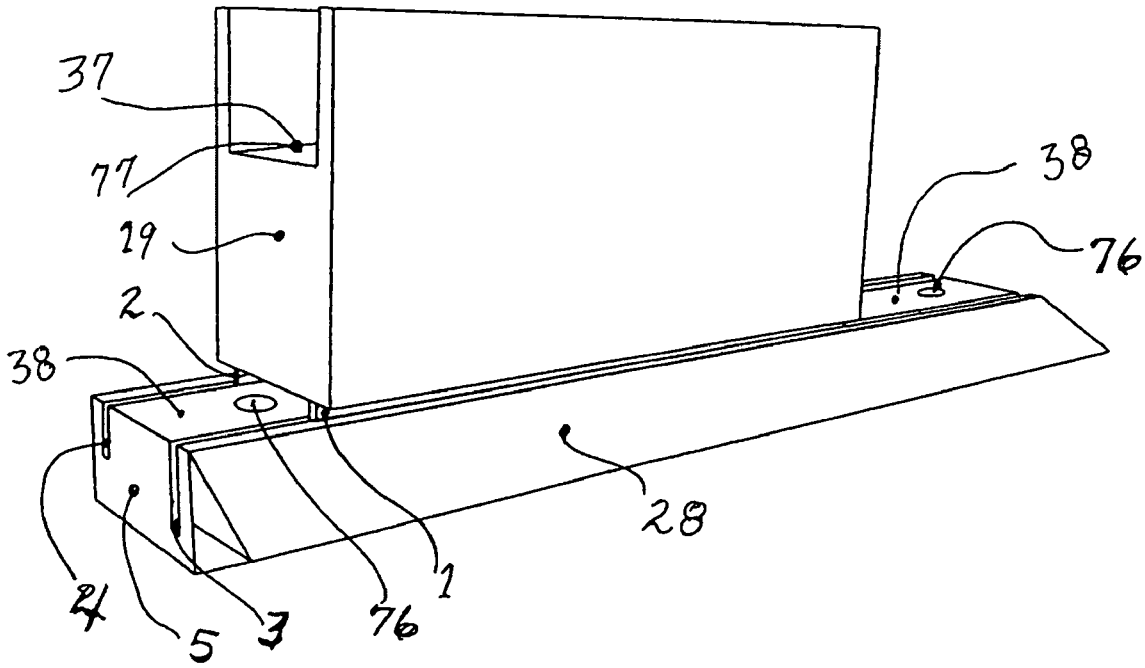
Figure 8:
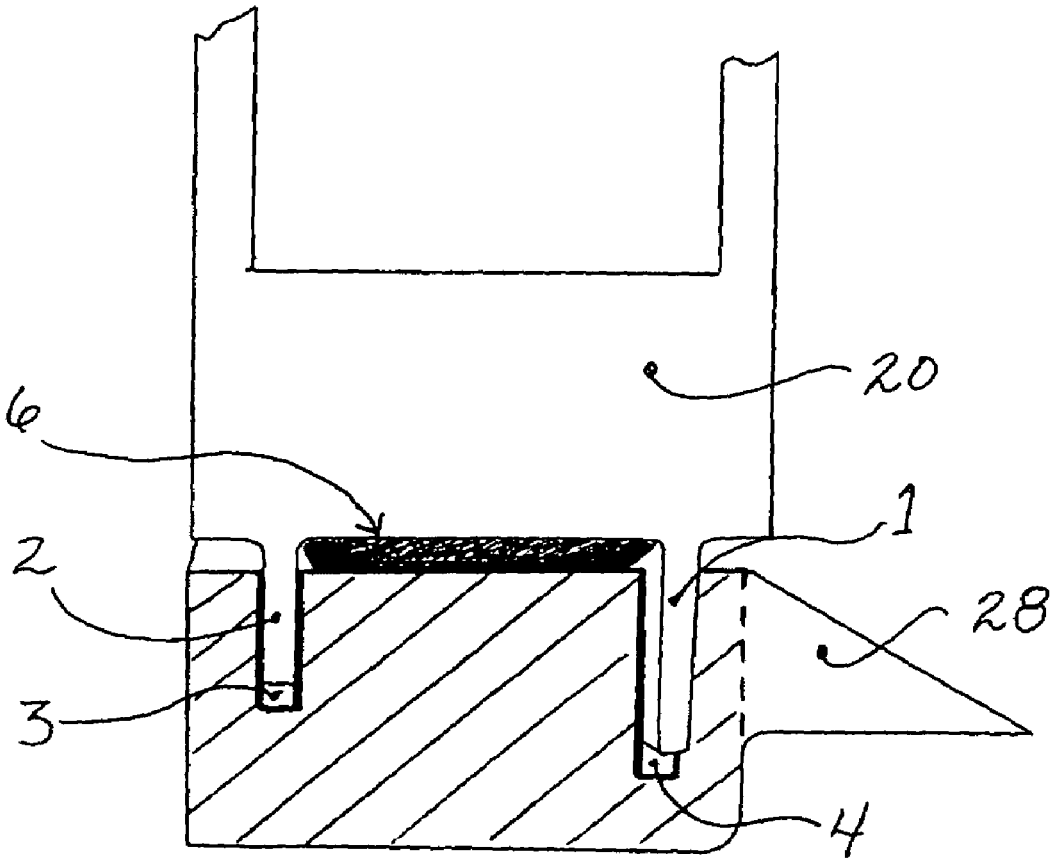
Figure 9:
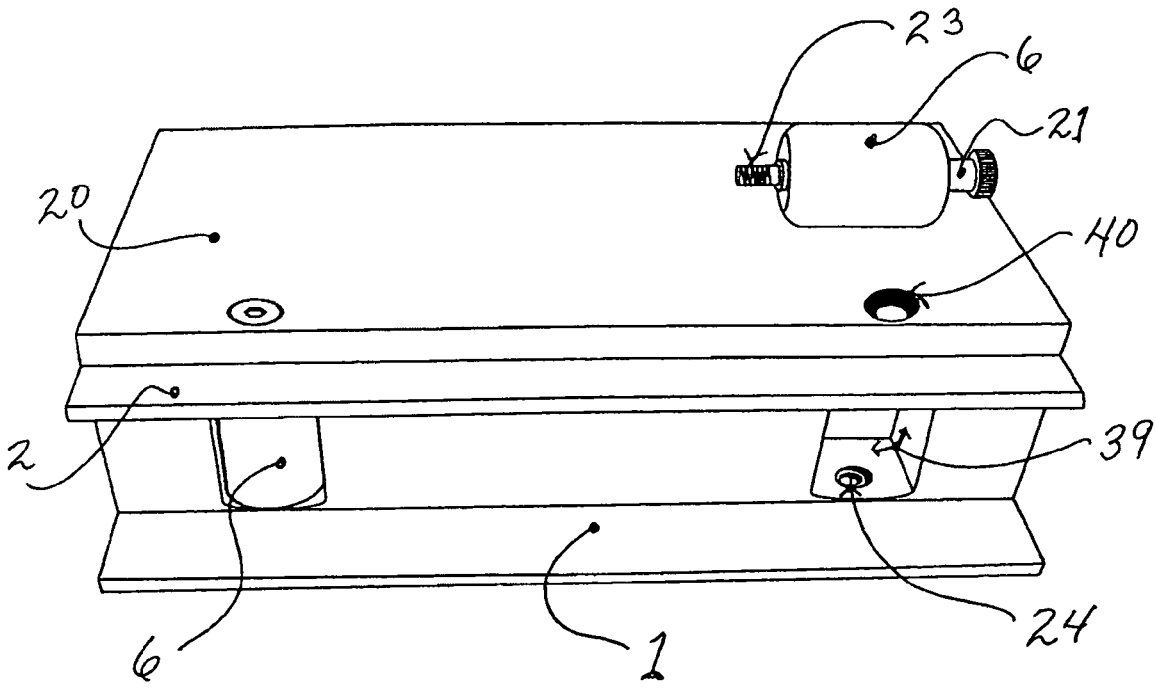
Figure 10:
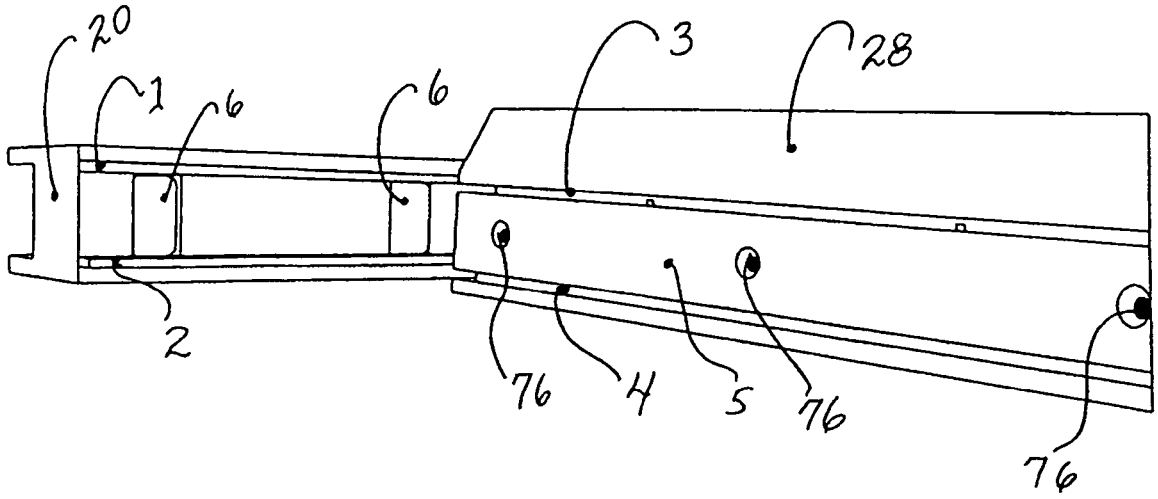

1) Placement of escapement drains, through grooves in the guide channels, at each end of the track. The remote possibility of water accumulation would be removed through active and passive drainage. This is enhanced by the close fit, of the sliding door guide in the track channel, which actively forces the water out through the drains upon closing. FIGS. 2, 3 and 4.

2) Removable guide channels equipped with full-length felt or nylon bristle linings on both sides. A simple hosing, by the meticulously inclined, will flush away what little dirt that might accumulate.
3) Placement of an insulated felt pad, on the inside track frame, to provide insulation for the inside floor in cold climates. FIG. 2.
4) Any portion of the "sliding door assembly, except the rollers, can be sprayed or powder-coated in a variety of colors.
5) The invention can be applied to the largest of commercial sliding doors, utilizing axled metal rollers on ball bearing races.
6) Security with window systems can be similarly affected with this invention. The key is the pair of guides under each window section. This can be accomplished with, or without, nylon rollers on each end. With smaller windows, rollers are not necessary when the load is not heavy and the occluding track surfaces are nylon.
7) Angled step plates to eliminate a 90-degree step. Three options include: a) A solid (fixed) one-piece, 10–30 degree design, included as part of the track; b) A hinged plate welded to the track; c) An "after market" hinged plate that can be screw-fastened to the track or its foundation.

SAFETY: This invention removes all barriers to foot and wheel traffic. Protruding rail tracks are replaced by a flat surface thereby eliminating the chance of tripping and falling. Wheelchairs, handcarts and toys, furniture and appliances on wheels can now easily pass through. A serious obstacle, especially for the handicapped, is permanently removed.

SECURITY: To complete this aspect of the invention, adjustable metal constraints* are placed in each ceiling end of the sliding door panel. The "sliding door retentive system" is comprised of the outside and inside guides positioned in their respective channels with the constraints* locked in place. No further adjusting is required unless the sliding door needs to be removed. Then, it's a simple matter of lowering the two constraints back into their housings, raising the door panel's guides off their track and tilting the door outward. Displacement of the invention's sliding door off its track, by vertical** forced entry, or hurricane-force winds, is impossible when used in conjunction with the adjustable metal constraints* positioned on top, and at each end, of every sliding and stationary door panel.

What we claim as our inventions are as follows:

1. A sliding door system comprising:

a door frame to be positioned in a structure opening comprising a flat, metal, floor-level roller glide surface extending in a longitudinal direction that does not impede foot or wheel traffic, said roller glide surface comprising metal outside and inside guide channels extending longitudinally the full length of the roller glide surface, a sliding door, slidably positioned in said door frame, said sliding door including two wide, solid nylon rollers that are situated between and extend in width slightly less than a lateral distance between said outside and inside guide channels, said sliding door further including metal, precision-fitted outside and inside guides corresponding to said outside and inside guide channels, said outside and inside guides extend longitudinally the full length of said sliding door, an angled step plate adjacent to said roller glide surface, wherein said outside guide is vertically longer than said inside guide, which prevents lateral displacement of said sliding door to prevent forced entry from outside said sliding door.

2. A sliding door system according to claim 1, wherein said door frame is attached to the structure opening with stainless steel anchor screws that extend perpendicularly from the top of the roller guide surface to the bottom of the structure opening.

3. A sliding door system according to claim 1, wherein the outside and inside guide channels correspond in width, length and height to their counterpart guides, such that said outside and inside guide channels maintain close space tolerances without metal to metal contact.

* * * * *